US007460926B2

(12) United States Patent
Okamoto

(10) Patent No.: US 7,460,926 B2
(45) Date of Patent: Dec. 2, 2008

(54) KNITTING METHOD OF TUBULAR KNITTED FABRIC

(75) Inventor: Kazuyoshi Okamoto, Wakayama (JP)

(73) Assignee: Shima Seiki Mfg., Ltd, Wakayama (JP)

( * ) Notice: Subject to any disclaimer, the term of this patent is extended or adjusted under 35 U.S.C. 154(b) by 0 days.

(21) Appl. No.: 11/911,286

(22) PCT Filed: Apr. 11, 2006

(86) PCT No.: PCT/JP2006/307602

§ 371 (c)(1),
(2), (4) Date: Oct. 11, 2007

(87) PCT Pub. No.: WO2006/109782

PCT Pub. Date: Oct. 19, 2006

(65) Prior Publication Data

US 2008/0141729 A1 Jun. 19, 2008

(30) Foreign Application Priority Data

Apr. 12, 2005 (JP) ..... 2005-115129

(51) Int. Cl.
*D04B 7/34* (2006.01)
*G06F 19/00* (2006.01)

(52) U.S. Cl. ..... 700/141; 66/64; 66/65; 66/174; 66/176

(58) Field of Classification Search ..... 66/64, 66/176, 69, 171, 189, 175, 174, 65; 700/141, 700/130, 140

See application file for complete search history.

(56) References Cited

U.S. PATENT DOCUMENTS 6,021,650 A 2/2000 Okuno et al.
6,651,462 B2 * 11/2003 Okamoto ..... 66/64

(Continued)

FOREIGN PATENT DOCUMENTS

| | | |
|---|---|---|
| EP | 1 818 436 A1 | 8/2007 |
| JP | 62-21015 | 2/1987 |
| JP | 2946325 B2 | 2/1999 |
| JP | 2000-220064 A | 8/2000 |
| JP | 2000-239950 A | 9/2000 |

OTHER PUBLICATIONS

Emiko Shirakawa, "Book of Knitting", Bunka Publishing Bureau, Apr. 20, 1974, p. 395-396.

*Primary Examiner*—Danny Worrell
(74) *Attorney, Agent, or Firm*—Rothwell, Figg, Ernst, Manbeck, PC

(57) ABSTRACT

A knitting method provides an easy-to-wear knitted tubular knitted fabric which gives little stretching feeling and exhibits high fitness upon wearing by joining at least three tubular parts. The method of a tubular knitted fabric using a flat knitting machine having at least a pair of front and back needle beds extending in a transverse direction and disposed opposite to each other in a cross direction, at least either of which is racked in the transverse direction so that loops can be transferred between the front and back needle beds comprises an operation of joining two tubular parts at a boundary of front and back knitted fabrics to form a tubular part is repeated; wherein the boundary is set so that the front knitted fabric and the back knitted fabrics are different in length in a knitting width direction immediately before joining for at least one tubular part; the tubular part in which the front and back knitted fabrics are different in length in the knitting width direction and the boundary to be joined is not positioned between the front and back needle beds is rotated so that the boundary is positioned between the front and back needle beds; and two adjacent tubular parts having the boundaries opposed to each other between the needle beds are joined while holding the boundary in between after the rotation.

11 Claims, 6 Drawing Sheets

U.S. PATENT DOCUMENTS 6,658,899 B2 * 12/2003 Okamoto ..... 66/64
6,748,770 B2 * 6/2004 Okamoto ..... 66/64
6,889,530 B2 * 5/2005 Urano et al. ..... 66/64
6,981,392 B2 1/2006 Miyai
7,181,309 B2 2/2007 Kazuyoshi
7,212,881 B2 5/2007 Kazuyoshi

* cited by examiner

KNITTING METHOD OF TUBULAR KNITTED FABRIC

CROSS REFERENCE TO RELATED APPLICATION

This application is a 35 USC § 371 National Phase Entry Application from PCT/JP2006/307602, filed Apr. 11, 2006, and designating the United States.

TECHNICAL FIELD

The present invention relates to a knitting method of a tubular knitted fabric in which at least three separately knitted tubular parts knitted using a flat knitting machine are joined, the tubular knitted fabric exhibiting high fitness upon wearing.

BACKGROUND ART

The tubular knitted fabric in which at least three separately knitted tubular parts are joined includes gloves with tubular finger portions, socks with tubular finger portions, sweaters, and the like. When knitting a sweater using the flat knitting machine, a body is set up from a hem part, a sleeve is set up from a cuff part, and a tubular body (tubular part) and tubular sleeves (tubular parts) are joined at an armhole part.

When using the flat knitting machine, gloves and socks with tubular finger portions are normally set up from fingertips of each tubular finger portion as one tubular part. Each tubular finger portion is joined at the finger crotch. In the case of gloves, each tubular finger portion of little finger, ring finger, middle finger, and forefinger is knitted, and one tubular part is formed while joining the tubular finger portions to each other at the finger crotches to knit a four-finger body, and thereafter, the tubular finger portion for the thumb finger is knitted and the relevant tubular finger portion for the thumb finger and the four-finger body are combined to knit a five-finger body.

The knitting of gloves and socks may be carried out by knitting the tubular finger portions one at a time and joining the tubular finger portions to each other at the finger crotch (see e.g., Patent Document 2), or may be carried out by joining three tubular finger portions and knitting a three-finger body, and thereafter joining another one tubular finger portion to the three-finger body to knit a four-finger body, and joining the remaining tubular finger portion to the four-finger body to knit a five-finger body (see Patent Document 3). Furthermore, in the case of gloves, the thumb finger tubular finger portion is joined to the four-finger body, the position of joining to the four-finger body of the thumb finger tubular finger portion being a position closer to the center side of the palm so that the thumb finger tubular finger portion fits the shape of the human hand (see Patent Document 4).

Patent Document 1: Japanese Laid-Open Patent Publication No. 10-266047

Patent Document 2: Japanese Laid-Open Patent Publication No. 2000-239950

Patent Document 3: Japanese Laid-Open Patent Publication No. 2000-220064

Patent Document 4: Pamphlet of International Publication No. 2004/020719

DISCLOSURE OF THE INVENTION

Problem to be Solved by the Invention

In particular, in gloves or socks with tubular finger portions, as shown in FIG. 8, generally, a knitted fabric A1 on a back side of a hand or an instep side of a foot in a tubular finger portion A is knitted with one of front and back needle beds, and a knitted fabric A2 on a palm side of the hand or a sole side of the foot in the tubular finger portion A is knitted with the other needle bed. As shown in FIG. 8, the tubular finger portion A is normally knitted in a tubular form so that the number of loops (number of loops knitted with one needle bed) in a knitting width direction of the knitted fabric on the back side of the hand or the instep side of the foot and the number of loops (number of loops knitted with the other needle bed) in the knitting width direction of the knitted fabric on the palm side of the hand or the sole side of the foot are of same number.

A boundary (X) of the knitted fabric on the back side of the hand or the instep side of the foot and the knitted fabric on the palm side of the hand or the sole side of the foot is positioned between the front and back needle beds, as shown in FIG. 8, where the tubular finger portions A are joined at the boundary portion to form a finger crotch B. Therefore, the finger crotch B formed in the gloves or the socks will be located at the middle of the thickness with respect to the thickness of the hand or the foot when the glove or the sock is worn by the hand or the foot.

Regarding a shape of the actual hand or foot, the position of the tip of the finger crotch is closer to the palm side of the hand or the sole side of the foot with respect to the thickness of the foot or the hand, which finger crotch has a shape inclined from the distal end thereof towards the back side of the hand or an instep side of the foot. Thus, if the position of the distal end of the finger crotch is the boundary of the back side or the instep side and the palm side or the sole side of the finger, the peripheral length of the finger has the length on the back side of the hand or the instep side of the foot longer than the length on the palm side of the hand or the sole side of the foot with respect to the boundary.

Therefore, in the actual hand or foot, the distal end of the finger crotch is arranged closer to the palm side of the hand or the sole side of the foot instead of the back side of the hand or the instep side of the foot with respect to the thickness of the hand or the foot. Therefore, since, in the conventional gloves or socks described above, the finger crotch is formed at the middle position in the thickness direction of the hand and the foot, the position of the finger crotch of the hand or the foot of the actual person and the position of the finger crotch of the gloves and the socks may shift when the gloves or the socks are worn. Consequently, the wear comfort of the gloves or the socks is not satisfactory, and they are also difficult to wear.

In the case of gloves, the tubular finger portion of the thumb finger is preferably joined closer to the palm side with respect to the four-finger body so as to fit the shape of one's hand, as shown in Patent Document 4. However, even if the tubular finger portion of the thumb finger is simply joined to the four-finger body at closer to the center of the palm, the position of the finger crotch at which each tubular finger portion is joined will shift from the position of the distal end of the finger crotch of the person, and thus the wear comfort will still be uncomfortable.

In the case of a sweater formed by joining three tubular parts, when knitting the body part to a tubular form, the sweater is normally knitted so that the length in the knitting width direction of the knitted fabric of a front body (front knitted fabric) and that of a back body (back knitted fabric) are of the same length.

The movement of the arm of a human generally includes the operation of placing the arm towards the front with respect to the torso. In view of such movement of the arm, the sweater will allow easier movement if the sleeves are joined to the tubular body so that the length in the knitting width direction of the front knitted fabric is shorter than that of the back knitted fabric compared to when joined so that the lengths in the knitting width direction of the front knitted fabric and the back knitted fabric are of the same length.

It is an object of the present invention to provide a knitting method of an easy-to-wear knitted tubular knitted fabric which gives little stretching feeling and exhibits high fitness upon wearing by joining at least three tubular parts so that the front and back knitted fabrics are different in length in the knitting width direction with respect to at least one tubular part in accordance with the shape of the human body.

Means for Solving the Problem

A knitting method of a tubular knitted fabric of the present invention is a knitting method of tubular knitted fabric formed by joining at least three separated tubular parts using a flat knitting machine having at least a pair of front and back needle beds extending in a transverse direction and disposed opposite to each other in a cross direction, at least either of which is capable of being racked in the transverse direction so that loops can be transferred between the front and back needle beds.

In the knitting method of the present invention, an operation for joining two tubular parts at a boundary of front and back knitted fabrics to form one tubular part is repeated to join tubular parts; and the boundary is set so that the front knitted fabric and the back knitted fabric are different in length in a knitting width direction immediately before joining for at least one tubular part. Furthermore, in the knitting method of the present invention, for a tubular part in which the front and back knitted fabrics are different in length in the knitting width direction and the boundary to be joined is not positioned between the front and back needle beds, the tubular part is rotated so that the boundary is positioned between the front and back needle beds, and thereafter, two adjacent tubular parts having the boundaries opposed to each other between the needle beds are joined while holding the boundary in between.

The boundary is set so that the front knitted fabric and the back knitted fabric are different in length in the knitting width direction immediately before joining for at least one tubular part, but the setting of the boundary refers to virtually setting the position of the boundary on the needle bed immediately before joining for each tubular part before two tubular parts are joined. Moreover, regarding the setting of the position of the boundary, the setting is performed so that the front knitted fabric and the back knitted fabric are different in length in the knitting width direction when the joining of the tubular parts is completed regardless of the formation of the gore.

For example, the joining of the two tubular parts while holding the boundary in between includes a case of joining without forming the gore, a case of joining while forming the gore so that the length of the gore of the front and back knitted fabrics is the same length, and a case of joining while forming the gore so that the length of the gore differs for the front and back knitted fabrics. In either case, the boundary is set so that the front and back knitted fabric parts are different in length in the knitting width direction for the knitted fabric excluding the joined part.

Regarding the setting of the boundary of the separately knitted tubular part, the boundary may be set at the stage of the start of the knitting of the tubular part, the boundary may be set at the knitting stage of knitting up to the joining starting location, or the boundary may be set immediately before the start of the joining. The stage of the start of the knitting of the tubular part refers to a time point of starting to knit from the finger tip of the tubular finger portion and starting to knit in a tubular form at the state in which the number of wale is the same for gloves and socks, and refers to a time point of starting to knit a cuff part or a hem part that is to be knitted in rib knitting or a time point of starting to knit a knitted fabric part formed following the completion of knitting of the cuff part or the hem part of rib knitting for a sweater.

For the separately knitted tubular parts, when the boundary is set so that the front and back knitted fabrics are different in length in the knitting width direction at the stage of the start of the knitting of the tubular part or at the knitting stage of knitting up to the joining starting location, the tubular part is knitted up to the joining starting location, and thereafter, the tubular part is rotated so that the boundary is positioned between the front and back needle beds, to join the tubular parts from the boundary positioned between the front and back needle beds. Alternatively, when the boundary is set similarly at the stage of the start of the knitting or at the knitting stage of knitting up to the joining starting location, the tubular part is rotated so that the boundary is positioned between the front and back needle beds, and the tubular part is knitted up to the joining starting location, and the tubular parts are joined from the boundary positioned between the front and back needle beds.

The knitting method of the tubular knitted fabric of the present invention preferably includes the following steps:

a) rotating the tubular part in which the boundary on the joining side is not positioned between the front and back needle beds so that the boundary on the joining side is positioned between the front and back needle beds for the two tubular parts to be joined;

b) joining the front knitted fabrics and the back knitted fabrics respectively by double stitching and performing a bind-off process with the boundaries in between for the two tubular parts for the two tubular parts;

c) rotating the tubular part in which the boundary on the joining side is not positioned between the front and back needle beds so that the boundary on the joining side is positioned between the front and back needle beds for the tubular part formed in one tubular form by joining the two tubular parts and the tubular part to be joined next;

d) joining the front knitted fabrics and the back knitted fabrics by double stitching and performing the bind-off process with the boundaries in between for the two tubular parts in the state of step c;

e) repeating step c to step d until all the tubular parts are joined when the tubular parts to be joined are four or more.

In joining two tubular parts, a gore may be formed at a joined part. As described above, the gore may be formed by double stitching the front knitted fabrics and the back knitted fabrics respectively and then performing the bind-off process.

In joining the tubular parts while forming the gore, the number of loops of the joined tubular part can be reduced by forming the gore. Since the number of loops can be reduced by forming the gore, the loops do not need to be reduced while knitting the tubular part after the formation of the gore, and the shift of wale does not occur in the tubular part.

In forming the gore at the joined part, the size of the gore may differ between the front and back knitted fabrics. In this case, the gore is formed through the double stitching and bind-off process, and the number of loops to be double stitched are differed for the front and back knitted fabrics. Furthermore, the lengths in the knitting width direction of the front and back knitted fabrics may be differed at the completion of joining of the tubular parts, and the lengths of the front and back gore may be differed, so that the shape of the knitted fabric can be knitted to a shape that fits for the shape of the human body. The case in which the length of the gore portion of the front knitted fabric and the back knitted fabric is different includes a case in which the gore is not formed in one of the knitted fabric.

Moreover, in joining the two tubular parts so that the size of the gore differs for the front and back knitted fabrics, the position of the boundary on the non-joining side of the tubular part is set on the needle bed so that the position of the boundary is at the same position with respect to the end of the knitting width of the knitted fabric held on the needle bed immediately before joining and after joining.

Specifically, for the tubular part that must be rotated to position the boundary on the joining side between the front and back needle beds, the position of the boundary is set so that the position of the boundary on the non-joining side of the tubular part before rotation of the tubular part and the position of the boundary on the non-joining side of the tubular part after the completion of the formation of the gore are at the same position with respect to the end of the knitted width of the tubular part. The position of the boundary is set based on the front and back difference of the gore of the knitted fabrics to be knitted and the number of loops to be rotated that occur as a result of the front and back difference of the gore.

In order to set the boundary so as to be the same position with respect to the end in the knitting width before and after the formation of the gore of the tubular part, the boundary is preferably virtually set from the stage of the start of the knitting of the tubular part. If the boundary is set from the start of the knitting, the tubular part is knitted in a tubular form from the start of the knitting up to the joining starting location, the tubular part is rotated immediately before joining, the joining side boundary is positioned between the front and back needle beds, and the gore is formed by double stitching the tubular part from the boundary and performing the bind-off process while rotating the loops of the tubular part.

In the knitting method of the present invention, for glove or sock for example, when knitted up to the finger crotch forming position, the tubular part that is to become the tubular finger portion is set with the boundary as the boundary of the finger crotch of the tubular part (the boundary of the frond and back knitted fabrics), so that the length in the knitting width direction of the knitted fabric on the back side of the hand or the instep side of the foot is different from the length in the knitting direction of the knitted fabric on the palm side of the hand or the sole side of the foot at the finger crotch forming position of the tubular part.

The position of the boundary in glove and sock can be set so that the length in the knitting width direction of the knitted fabric on the back side of the hand or the instep side of the foot is longer than that on the palm side of the hand or the sole side of the foot for all the tubular finger portions or some tubular finger portions. When setting so that the length in the knitting width direction of the knitted fabric on the back side of the hand or the instep side of the foot is longer for some tubular finger portions, setting may be performed so that the length of the knitted fabric on the back side of the hand or the instep side of the foot and that on the palm side of the hand or the sole side of the foot are the same for other tubular finger portions, or the length in the knitting width direction of the knitted fabric on the back side of the hand or the instep side of the foot is shorter than that on the palm side of the hand or the sole side of the foot.

For example, for the tubular finger portion of the thumb, the length in the knitting width direction of the knitted fabric on the back side of the hand or the instep side of the foot is set shorter than that on the palm side of the hand or the sole side of the foot, whereas the length in the knitting width direction of the knitted fabric on the back side of the hand or the instep side of the foot is set longer than that on the palm side of the hand or the sole side of the foot for the tubular finger portions other than the thumb.

In the case of a sweater, the boundary of the knitted fabric of the front body and the knitted fabric of the back body is set so that the length of the knitted fabric of the back body (back knitted fabric) is longer than that of the front body (front knitted fabric), and the boundary is set for the left and right sleeves so that the length in the knitting width direction of the knitted fabric of the back side is longer than that of the front side.

When joining the tubular parts, if the boundary on the joining side is not positioned between the front and back needle beds, the tubular part is rotated so that the boundary is positioned between the front and back needle beds before joining. The two tubular parts in which the respective boundary on the joining side is positioned between the front and back needle beds are joined at the boundaries.

Furthermore, in knitting and joining the tubular parts, the tubular parts may be joined two at a time after knitting a plurality of tubular parts up to the joining starting location, or the tubular parts may be joined after knitted the tubular part one at a time.

When the joining of the plurality of tubular parts including the tubular part in which the front and back knitted fabrics are different in length in the knitting width direction is completed, the number of loops on the front knitted fabric of the tubular part and the number of loops of the back knitted fabric are different in the course of the portion at where the tubular parts are joined for the tubular part in which the lengths in the front and back knitted fabrics in the knitting width direction differ before joining. Due to the difference in the number of loops of the front and back knitted fabrics, the tubular knitted fabric in which a plurality of tubular parts are joined can be knitted so that the tubular part bulges out towards the side of greater number of loops.

Rotation of the tubular part refers to the operation of rotating the entire knitted fabric while transferring the loops positioned on a diagonal line on the needle bed to the needle of the opposing needle bed among the loops of both ends in the knitting width of the tubular part. The rotation of the knitted fabric refers to the operation of moving the loops at the ends of the knitting width of the tubular knitted fabric towards the center side in the knitting width while transferring the loops to the opposing needle bed while reducing the loops of the tubular knitted fabric by double stitching.

When the tubular knitted fabric is a glove or sock with tubular finger portions knitted from the finger tip, the tubular part refers to the tubular part forming the tubular finger portion, the tubular part formed by joining two tubular finger portions, and the tubular part formed by sequentially joining three or more tubular finger portions. The tubular part formed by sequentially joining three or more tubular finger portions includes a tubular part (three-finger body) formed by joining a tubular part or a tubular finger portion to the tubular part (two-finger body) formed by joining two tubular finger portions, a tubular part (four-finger body) formed by joining a tubular part or a tubular finger portion to the three-finger body, and a tubular part (four-finger body) formed by forming two tubular parts (two-finger body) each being formed by joining two tubular finger portions, and joining the same.

In the case of a glove or sock with five fingers, two tubular finger portions (tubular parts) are joined to form the two-finger body (tubular part), the two-finger body is joined to a tubular finger portion (tubular part) to be joined next to form a three-finger body (tubular part), the three-finger body is joined to a tubular finger portion (tubular part) to be joined next to form a four-finger body (tubular part), and the four-finger body is joined to a tubular finger portion (tubular part) to be joined next to form a five-finger body (tubular part) thereby obtaining a state in which five tubular finger portions are joined at the finger crotches. In this case, tubular parts that are not tubular finger portions such as two-finger body and three-finger body are also set with the boundary so that the front and back knitted fabrics are different in length in the knitting width direction, where the tubular part such as two-finger body is rotated so that the boundary on the joining side is positioned between the front and back needle beds when joining the tubular part such as two-finger body to the tubular finger portion.

The tubular part in the case of the sweater refers to the body and left and right sleeves, which are knitted to a tubular form respectively, and a tubular part formed by joining the body and one of the sleeves. The joining of the tubular parts in the case of the sweater includes joining the tubular part forming the body and the tubular part forming one sleeve, and thereafter, joining the tubular part in which two tubular parts are joined and a tubular part forming the other sleeve.

The setting of the boundary described above as well as the setting of whether or not to perform the rotating operation of the tubular part are set in a design system. In the design system, a knitting program including a setting command of setting the boundary of the front and back knitted fabrics at the point when the separately knitted tubular parts are knitted up to the joining starting location, and a knitting program including a rotation command of rotating the tubular part set with the boundary are created.

The knitting program specifically has the following commands: a determining command of determining two tubular parts to be joined; a setting command of setting positions of the boundaries of the front knitted fabrics and the back knitted fabrics immediately before joining so that the length in the knitting width direction of the front and back knitted fabrics are of desired length respectively when the tubular parts determined to be joined by the determining command are joined; a rotation command of rotating the tubular so that the boundary is positioned between the front and back needle beds immediately before joining for the tubular part in which lengths in the knitting width direction of the front and back knitted fabrics differ and the boundary on the joining side is not positioned between the front and back needle beds by the setting command; a joining command of joining two adjacent tubular parts in which the boundaries are opposed to each other between the needle beds while holding the boundary in between to form one tubular part according to the setting command and the rotation command for the tubular parts determined to be joined by the determining command; and a repeating command of repeating the determining command, the setting command, the rotation command, and the joining command until all the tubular parts are joined.

The position of the boundary set by the setting command may be set so that the number of loops in the knitting width direction of the front knitted fabric is greater than that of the back knitted fabric, or may be set so that the number of loops in the knitting width direction of the front knitted fabric is less than that of the back knitted fabric.

The boundary of each tubular part set by the design system is programmed so that the boundary on the non-joined side becomes a boundary for joining with another tubular part as the boundary of the tubular part joined to another tubular part after the previous joining of the tubular parts is completed. Furthermore, a knitting program for knitting the tubular knitted fabric with the flat knitting machine according to the design is created in the design system.

According to such programs, if the boundaries to be joined in the tubular part are not positioned between the front and back needle beds, the flat knitting machine controls rotating the tubular part so that the boundary is positioned between the front and back needle beds, or joining the tubular parts at the boundary.

In the present invention, the glove or the sock in which the tubular parts are joined so that the front knitted fabric and the back knitted fabric in the knitting width direction are different in length for at least one tubular part forming the tubular finger portion are obtained by the knitting method described above using the flat knitting machine in which needle beds provided with a great number of knitting needles are disposed opposite to each other in a cross direction.

Specifically. a glove or a sock with tubular finger portions knitted in a seamless manner from the tubular finger portion using a flat knitting machine in which needle beds provided with a great number of knitting needles are disposed opposite to each other in a cross direction, wherein a boundary between a front knitted fabric and a back knitted fabric immediately before joining is set so that lengths of the front knitted fabric and the back knitted fabric in a knitting width direction are different for at least one tubular part forming the tubular finger portion. the tubular finger portion being formed by joining adjacent tubular parts at the boundary.

Furthermore, in the present invention, a sweater in which a tubular part forming the body and a tubular part forming the sleeve are joined so that lengths in a knitting width direction of a front knitted fabric and a back knitted fabric are different is obtained by the knitting method described above using the flat knitting machine in which needle beds provided with a great number of knitting needles are disposed opposite to each other in a cross direction.

Specifically, a sweater including a body and sleeves knitted in a seamless manner from a hem part using a flat knitting machine in which needle beds provided with a great number of knitting needles are disposed opposite to each other in a cross direction, wherein a boundary between a front knitted fabric and a back knitted fabric of the body and each sleeve immediately before joining is set so that lengths of the front knitted fabric and the back knitted fabric in a knitting width direction of a tubular part forming the body are different, and lengths of the front knitted fabric and the back knitted fabric in a knitting width direction of tubular parts forming the sleeves are the same, the tubular part forming the body and the tubular parts forming the sleeves being joined at the opposing boundary.

EFFECT OF THE INVENTION

In the knitting method of the tubular knitted fabric of the present invention, when joining at least three separately knitted tubular parts, the boundary of the front and back knitted fabrics is set so that the length in the knitting width direction of the front knitted fabric is different from that of the back knitted fabric for at least one tubular part out of the tubular parts. If the front and back knitted fabrics are different in length and the boundary on the side to be joined is not positioned between the front and back needle beds, the tubular parts are joined at the boundary after rotating the tubular part so that the boundary is positioned between the front and back needle beds, and thus a tubular knitted fabric having a shape that is three-dimensional and that fits for the shape of a human body can be knitted.

In particular, when knitting a glove or sock with tubular finger portions, finger crotch can be formed so that the length in the knitting width direction of the knitted fabric on the back side of the hand or the instep side of the foot is longer than that on the palm side of the hand or the sole side of the foot. When the knitting of the glove or the sock is completed, respective tubular finger portions have the back side of the hand or the instep side of the foot three-dimensionally bulging out at the finger crotches that become the joined parts of the tubular finger portions, and furthermore, the finger crotches are formed to be closer to the sole side of the foot in the case of socks and to be closer to the palm side in the case of gloves. As a result, the gloves or socks can be easily worn, and high fitness is exhibited upon wearing.

In the case of sweater with sleeves, the tubular knitted fabric can be knitted to a joined state in which the length in the knitting width direction of the front knitted fabric is shorter than that of the back knitted fabric with respect to the tubular body, and thus high fitness is exhibited upon wearing the sweater, thus allowing easy movement.

In joining the tubular parts, the position of the boundary that is not joined can be made to a wale in which the twist of loops does not occur by setting the position of the boundary so that the boundary is at the same position with respect to the end of the knitted width of the tubular part held on the needle bed immediately before joining and rotating and after the formation of the gore in the case of forming a gore having different front and back lengths. That is, twist of loops is less likely to occur after forming the gore even if the gore is formed while rotating the knitted fabric, and thus the shift of wale doe not occur, and the satisfactory outer appearance is obtained. For example, in the case of gloves and socks, a wale in which the twist of the loops does not occur is formed from the little finger to four-finger body and to the five-finger body, or from the thumb finger to the five-finger body.

Furthermore, when knitting a glove or sock, if the five-finger body is knitted while maintaining the number of loops in the peripheral direction of the tubular finger portions at the finger crotches, the peripheral length of the five-finger body becomes too large, and thus the loops must be reduced while knitting the five-finger body. However, in the present invention, the loops can be reduced while forming the gores, and thus the loops do not need to be reduced while knitting the five-finger body.

BEST MODE FOR CARRYING OUT THE INVENTION

The preferred embodiment of the present invention will now be described in detail below based on the drawings. In the following embodiments, a glove with tubular finger portions will be manufactured using a so-called two-bed flat knitting machine having a pair of front and back needle beds extending in a transverse direction and disposed opposite to each other in a cross direction, where the back needle bed is capable of being racked in the transverse direction so that loops can be transferred between the front and back needle beds.

In a first embodiment and a second embodiment described below, the two-bed flat knitting machine used is a two-bed flat knitting machine (e.g., SWG021 manufactured by Shima Seiki Mfg., Ltd.) equipped with a complex needle including a needle body with a hook at the distal end, and a slider configured by overlapping two thin plates. Through the use of the flat knitting machine equipped with the complex needle, the tubular knitted fabric can be knitted using all the needles without creating an empty needle. In the flat knitting machine equipped with the complex needle, loops are advanced with the slider of the complex needle in one needle bed to the other needle bed to deposit the loops on the slider of the complex needle in the other needle bed (method of depositing loops disclosed in Japanese Laid-Open Patent Publication No. 11-43849).

When knitting a tubular knitted fabric with the normal two-bed flat knitting machine using a needle not equipped with the slider, knitting is performed using every other needles of each of the front and back needle beds. For example, knitted fabrics on the palm side of the glove (hereinafter referred to as a front knitted fabric) are knitted primarily with odd needles of the front needle bed, and knitted fabrics on the back side of the glove (hereinafter referred to as a back knitted fabric) are knitted primarily with even needles of the back needle bed.

Further, when the normal two-bed flat knitting machine is used, the needles of the back needle bed opposing the needles on which the loops are held of the front needle bed are empty needles when knitting the front knitted fabrics with the front needle bed. When knitting the back knitted fabrics with the back needle bed, the needles of the front needle bed opposing the needles on which the loops are held of the back needle bed are the empty needles. Therefore, the front and back knitted fabrics each can constantly ensure empty needles for transferring loops in the opposing needle bed.

In the two-bed flat knitting machine, through the use of these sliders and empty needles, structure patterns of mixed front-and-back loops, such as links, purl stitches, and ribs, can be knitted and the front and back loops can be transferred in the direction of the knitting width so as to be joined to each other.

The two-bed flat knitting machine may be provided with a transfer jack bed(s) having transfer jacks arranged in line thereon and located over either or both of the front and back needle beds, for knitting the knitted fabrics.

As an alternative to the two-bed flat knitting machine used in the illustrated embodiments to knit gloves, a four-bed flat knitting machine comprising an upper front needle bed, a lower front needle bed, an upper back needle bed, and a lower back needle bed may be used for knitting.

When the four-bed flat knitting machine is used, for example the front knitted fabrics are assigned to the lower front needle bed and the back knitted fabrics are assigned to the lower back needle bed. Then, the upper back needle bed is used in the form of empty needles for loop transfer of the front knitted fabrics and back stitch formation thereof and so on when the front knitted fabrics are knitted, and the upper front needle bed is used in the form of empty needles for loop transfer of the back knitted fabrics and back stitch formation thereof when the back knitted fabrics are knitted.

In the embodiments described below, the glove with tubular finger portions will be knitted using the two-bed flat knitting machine in which the complex needle with the slider is arranged. In the present embodiment, the tubular finger portions are separately knitted to a tubular shape, and then the tubular finger portions are sequentially joined together to knit the glove.

FIRST EMBODIMENT

FIG. 1 is a plan view of a glove with five tubular finger portions according to a first embodiment. FIG. 2 is a knitting process drawing of the knitting method for the glove of FIG. 1. FIG. 3 is a cross sectional view showing a state before joining the tubular finger portions and a state after joining. As shown in FIG. 1, a tip of a middle finger tubular finger portion 23 is projected out the most in the glove 10 of the present embodiment, and the positions of the finger tips then lowers in order to a forefinger tubular finger portion 22, a ring finger tubular finger portion 24, a little finger tubular finger portion 25, and a thumb finger tubular finger portion 21.

A first finger crotch 31 is formed between the thumb finger tubular finger portion 21 and the forefinger tubular finger portion 22, a second finger crotch 32 is formed between the forefinger tubular finger portion 22 and the middle finger tubular finger portion 23, a third finger crotch 33 is formed between the middle finger tubular finger portion 23 and the ring finger tubular finger portion 24, and a fourth finger crotch 34 is formed between the ring finger tubular finger portion 24 and the little finger tubular finger portion 25. In the glove 10 of the first embodiment, the positions to be formed with the finger crotches lower towards the wrist in the order of second finger crotch 32, third finger crotch 33, fourth finger crotch 34, and the first finger crotch 31.

The tubular finger portions are individually knitted in the order of the forefinger tubular finger portion 22, the middle finger tubular finger portion 23, the ring finger tubular finger portion 24, the little tubular finger portion 25, and the thumb finger tubular finger portion 21.

After knitting the forefinger tubular finger portion 22 and the middle finger tubular finger portion 23, the forefinger tubular finger portion 22 and the middle finger tubular finger portion 23 are joined at the second finger crotch 32 to form a two-finger body 40. The ring finger tubular finger portion 24 is then knitted, and the ring finger tubular finger portion 24 and the middle finger tubular finger portion 23 of the two-finger body 40 are joined at the third finger crotch 33 to form a three-finger body 50. The little tubular finger portion 25 is then knitted, and the little finger tubular finger portion 25 and the ring finger tubular finger portion 24 of the three-finger body 50 are joined at the fourth finger crotch 34 to form a four-finger body 60. The thumb finger tubular finger portion 21 is then knitted, and the thumb finger tubular finger portion 21 and the forefinger tubular finger portion 22 of the four-finger body 60 are joined at the first finger crotch 31 to form a five-finger body 70. The five-finger body 70 is then knitted up to a hand inserting opening 12, thereby forming the glove 10.

In the present embodiment, the thumb finger tubular finger portion 21, the forefinger tubular finger portion 22, the middle finger tubular finger portion 23, the ring finger tubular finger portion 24, the little finger tubular finger portion 25, the two-finger body 40, the three-finger body 50, the four-finger body 60, and the five-finger body 70 are tubular parts in the present invention, and in particular, the thumb finger tubular finger portion 21, the forefinger tubular finger portion 22, the middle finger tubular finger portion 23, the ring finger tubular finger portion 24, the little finger tubular finger portion 25 are separately knitted tubular parts. Furthermore, in the present embodiment, the knitted fabric on the back side of the glove is knitted primarily using the needles of the back needle bed, and the knitted fabric on the palm side is knitted primarily using the needles of the front needle bed, but the knitted fabric on the back side of the glove may be knitted primarily using the needles of the front needle bed, and the knitted fabric on the palm side may be knitted primarily using the needles of the back needle bed.

For the sake of convenience of the explanation, concerning also the second embodiment, the knitting pattern of the glove 10 is presented in the form of a plain stitch with no pattern and the knitted pattern of the hand inserting opening 12 in the rib structure, but portions other than the hand inserting opening 12 may have another knit structure, such as jacquard and rib.

The method of knitting and joining the tubular finger portions of the present embodiment will be specifically described based on FIG. 2. The numerals at the left side of FIG. 2 indicate the respective steps of the knitting processes, and the squares indicated in each step indicate the state of the tubular knitted fabric. The line at the lower part of the square indicates the knitted fabric held on the needles of the front needle bed, and the line on the upper part indicates the knitted fabric held on the needles of the back needle bed. Furthermore, X marked on the line of the square indicates the boundary of the front knitted fabric (knitted fabric on palm side) and the back knitted fabric (knitted fabric on back side). These are the same for the knitting process drawings used in other embodiments.

Before knitting, a program for setting the boundary X of the front knitted fabric and the back knitted fabric at the point the thumb finger tubular finger portion 21, the forefinger tubular finger portion 22, the middle finger tubular finger portion 23, the ring finger tubular finger portion 24, the little finger tubular finger portion 25 are knitted to the finger crotch forming locations is created in a design system. This program is set in a control device such as a computer that controls the drive of the flat knitting machine. The knitting order of the five tubular finger portions as well as the knitting method that complies with the shape of the glove are also set in the program.

The programming of the setting of the boundary and the setting of the knitting order of the tubular finger portions in the design system is similarly carried out in other embodiments described below.

Each tubular finger portion is knitted according to the following knitting processes, and then the tubular finger portions are joined together. First, the forefinger tubular finger portion 22 is knitted up to a forming location of the second finger crotch 32 (step 1). After the knitting of step 1, two boundaries X are set at two locations so as to be symmetric in the knitting width of the loops held on the front needle bed. The boundaries X are set so that the number of the loops in the knitting width direction of the knitted fabric on the back side (back knitted fabric) is greater than that of the knitted fabric on the palm side (front knitted fabric). The boundaries X are also set for the middle finger tubular finger portion 23, the ring finger tubular finger portion 24, the little finger tubular finger portion 25, and the thumb finger tubular finger portion 21 respectively so that the number of loops in the knitting width direction of the knitted fabric on the back side (back knitted fabric) is greater than that of the knitted fabric on the palm side (front knitted fabric).

The knitted fabric of the forefinger tubular finger portion 22 is rotated counterclockwise so that the boundary X on the side to be joined to the middle finger tubular finger portion 23 is positioned between the front and back needle beds (step 2).

The middle finger tubular finger portion 23 is knitted to the forming location of the second finger crotch 32 (step 3). After the knitting of step 3, two boundaries X are set at two locations in the middle finger tubular finger portion 23 so as to be symmetric in the knitting width of the loops held on the front needle bed.

The knitted fabric of the middle finger tubular finger portion 23 is rotated clockwise so that the boundary X on the side to be joined to the forefinger tubular finger portion 22 is positioned between the front and back needle beds (step 4).

The middle finger tubular finger portion 23 is moved so that the loop at the end of the knitting width of the middle finger tubular finger portion 23 is adjacent to the loop at the end of the knitting width of the forefinger tubular finger portion 22. The movement of the middle finger tubular finger portion 23 includes, for example, transferring all the loops held on the back needle bed of the forefinger tubular finger portion 22 to the front needle bed, and transferring all the loops held on the front needle bed of the middle finger tubular finger portion 23 to the back needle bed. After racking the back needle bed to the forefinger tubular finger portion 22 side, the loops held on the front needle bed before racking of the loops of the middle finger tubular finger portion 23 held on the back needle bed are returned to the front needle bed, and the loops held on the back needle bed before racking of the loops of the forefinger tubular finger portion 22 held on the front needle bed are returned to the back needle bed. As a result of the movement of the middle finger tubular finger portion 23, the boundary X of the forefinger tubular finger portion 22 and the boundary X of the middle finger tubular finger portion 23 oppose each other (step 5). The movement of the middle finger tubular finger portion 23 may be carried out while performing the rotating operation of the middle finger tubular finger portion 23 of step 4.

From the state of step 5, the forefinger tubular finger portion 22 and the middle finger tubular finger portion 23 are joined from the boundary X. Specifically, the forefinger tubular finger portion 22 and the middle finger tubular finger portion 23 are joined by double stitching the front knitted fabrics and the back knitted fabrics from the boundary X and then performing a bind-off process. The bind-off process is performed up to a position b1 for the front knitted fabric and up to a positional for the back knitted fabric with respect to the forefinger tubular finger portion 22, and up to a position b2 for the front knitted fabric and up to a position a2 for the back knitted fabric with respect to the middle finger tubular finger portion 23.

The state of step 6 is obtained at the point the joining by the bind-off process is terminated, and the second finger crotch 32 having a gore at the joined part of the forefinger tubular finger portion 22 and the middle finger tubular finger portion 23 is formed. In the present embodiment, the length of the gore of the back knitted fabric (back side) is made longer than that of the front knitted fabric (palm side) for the gore of the second crotch 32. The two-finger body 40 having less number of loops than the total number of loops of the peripheral length of the forefinger tubular finger portion 22 and the middle finger tubular finger portion 23 can be formed by the double stitching when forming the gore. Similarly, the length of the gore of the back knitted fabric (back side) is longer than the length of the gore of the front knitted fabric (palm side) for the gores of the third finger crotch 33, the fourth finger crotch 34, and the first finger crotch 31 described below.

The two-finger body 40, in which the formation of the gore is completed, is circling-knitted up to the position of forming the third finger crotch 33. In such circling-knitting, since the positions of the boundaries X of the forefinger tubular finger portion 22 and the middle finger tubular finger portion 23 before rotating the tubular portions to be joined is at the same positions as the positions of the boundaries X of the two-finger body 40 after forming the gore, with respect to the end in the knitting width at the front needle bed, twisted loops will not form in the two-finger body 40, and circling-knitting can be continued after the gore is formed. Since the position of the boundary X on the non-joining side is the same position with respect to the end in the knitting width before and after joining the tubular part in the three-finger body 50, the four-finger body 60, and the five-finger body 70 as well, the twisted loops will not form, and circling-knitting can be continued after the gore is formed.

After the circling-knitting of the two-finger body 40, the two-finger body 40 is rotated counterclockwise so that the boundary X of the middle finger tubular finger portion 23 in the two-finger body 40 is positioned between the front and back needle beds (step 7).

The ring finger tubular finger portion 24 is knitted to the forming location of the third finger crotch 33 (step 8). After the knitting of step 8, two boundaries X are set at two locations in the ring finger tubular finger portion 24 so as to be symmetric in the knitting width of the loops held on the front needle bed.

The knitted fabric of the ring finger tubular finger portion 24 is rotated clockwise so that the boundary X on the side to be joined to the two-finger body 40 is positioned between the front and back needle beds (step 9). The ring finger tubular finger portion 24 is moved so that the loop at the end of the knitting width of the ring finger tubular finger portion 24 is adjacent to the loop at the end of the knitting width of the two-finger body 40. The movement of the ring finger tubular finger portion 24 is performed similar to the movement of the middle finger tubular finger portion 23 described above. As a result of the movement of the ring finger tubular finger portion 24, the boundary X of the ring finger tubular finger portion 24 and the boundary X of the two-finger body 40 oppose each other (step 10).

From the state of step 10, the two-finger body 40 and the ring finger tubular finger portion 24 are joined from the boundary X. Specifically, similar to the joining of the forefinger tubular finger portion 22 and the middle finger tubular finger portion 23, the bind-off process is performed after double stitching to join both tubular parts. The bind-off process is performed up to a position b3 for the front knitted fabric and up to a position a3 for the back knitted fabric with respect to the two-finger body 40, and up to a position b4 for the front knitted fabric and up to a position a4 for the back knitted fabric with respect to the ring finger tubular finger portion 24.

The state of step 11 is obtained at the point the joining by the bind-off process is terminated, and the third finger crotch 33 having a gore at the joined part of the two-finger body 40 and the ring finger tubular finger portion 24 is formed. The three-finger body 50 having less number of loops than the total number of loops of the peripheral length of the two-finger body 40 and the ring finger tubular finger portion 24 can be formed by the double stitching when forming the gore. The three-finger body 50, in which the formation of the gore is completed, is circling-knitted up to the position of forming the fourth finger crotch 34.

After the circling-knitting of the three-finger body 50, the three-finger body 50 is rotated counterclockwise so that the boundary X of the ring finger tubular finger portion 24 in the three-finger body 50 is positioned between the front and back needle beds (step 12).

The little finger tubular finger portion 25 is knitted to the forming location of the fourth finger crotch 34 (step 13). After the knitting of step 13, two boundaries X are set at two locations in the little finger tubular finger portion 25 so that the boundary X on the side to be joined to the three-finger body 50 is positioned on the front needle bed, and the other boundary X on the other side is positioned between the front and back needle beds, as shown in step 13 of FIG. 2.

The knitted fabric of the little finger tubular finger portion 25 is rotated clockwise so that the boundary X on the side to be joined to the three-finger body 50 is positioned between the front and back needle beds (step 14). The little finger tubular finger portion 25 is moved so that the loop at the end of the knitting width of the little finger tubular finger portion 25 is adjacent to the loop at the end of the knitting width of the three-finger body 50. The movement of the little finger tubular finger portion 25 is also performed similar to the movement of the middle finger tubular finger portion 23 described above. As a result of the movement of the little finger tubular finger portion 25, the boundary X of the little finger tubular finger portion 25 and the boundary X of the three-finger body 50 oppose each other (step 15).

From the state of step 15, the three-finger body 50 and the little finger tubular finger portion 25 are joined from the boundary X. Specifically, similar to the joining of the forefinger tubular finger portion 22 and the middle finger tubular finger portion 23, the bind-off process is performed after double stitching to join both tubular parts. The bind-off process is performed up to a position b5 for the front knitted fabric and up to a position a5 for the back knitted fabric with respect to the three-finger body 50, and up to a position b6 for the front knitted fabric and up to a position a6 for the back knitted fabric with respect to the little finger tubular finger portion 25.

The state of step 16 is obtained at the point the joining by the bind-off process is terminated, and the fourth finger crotch 34 having a gore at the joined part of the three-finger body 50 and the little finger tubular finger portion 25 is formed. The four-finger body 60 having less number of loops than the total number of loops of the peripheral length of the three-finger body 50 and the little finger tubular finger portion 25 can be formed by the double stitching when forming the gore. The fourth-finger body 60, in which the formation of the gore is completed, is circling-knitted up to the position of forming the first finger crotch 31.

After the circling-knitting of the four-finger body 60, the four-finger body 60 is rotated clockwise so that the boundary X on the forefinger tubular finger portion 22 in the four-finger body 60 is positioned between the front and back needle beds (step 17).

The thumb finger tubular finger portion 21 is knitted to the forming location of the first finger crotch 31 (step 18). After the knitting of step 18, two boundaries X are set at two locations in the thumb finger tubular finger portion 21 so that the boundary X on the side to be joined to the four-finger body 60 is positioned on the front needle bed, and the other boundary X on the other end side is positioned between the front and back needle beds, as shown in step 18 of FIG. 2.

The knitted fabric of the thumb finger tubular finger portion 21 is rotated counterclockwise so that the boundary X on the side to be joined to the four-finger body 60 is positioned between the front and back needle beds (step 19). The thumb finger tubular finger portion 21 is moved so that the loop at the end of the knitting width of the thumb finger tubular finger portion 21 is adjacent to the loop at the end of the knitting width of the four-finger body 60. The movement of the little finger tubular finger portion 25 is also performed similar to the movement of the middle finger tubular finger portion 23 in transferring loops, but the racking of the back needle bed is performed in the opposite direction. As a result of the movement of the thumb finger tubular finger portion 21, the boundary X of the thumb finger tubular finger portion 21 and the boundary X of the four-finger body 60 oppose each other (step 20).

From the state of step 20, the four-finger body 60 and the thumb finger tubular finger portion 21 are joined from the boundary X. Specifically, similar to the joining of the forefinger tubular finger portion 22 and the middle finger tubular finger portion 23, the bind-off process is performed after double stitching to join both tubular parts. The bind-off process is performed up to a position b8 for the front knitted fabric and up to a position a8 for the back knitted fabric with respect to the four-finger body 60, and up to a position b7 for the front knitted fabric and up to a position a7 for the back knitted fabric with respect to the thumb finger tubular finger portion 21.

The state of step 21 is obtained at the point the joining by the bind-off process is terminated, and the first finger crotch 31 having a gore at the joined part of the four-finger body 60 and the thumb finger tubular finger portion 21 is formed. The five-finger body 70 having less number of loops than the total number of loops of the peripheral length of the four-finger body 60 and the thumb finger tubular finger portion 21 can be formed by the double stitching in forming the gore.

The five-finger body 70, in which formation of gores is completed, is then circling-knitted with the same number of loops up to the vicinity of the hand inserting opening 12, and thereafter, knitted while reducing the loops to the rib knitting portion that is to become the hand inserting opening 12. After completion of formation of gores, positions of both boundaries X of the five-finger body 70 with respect to the respective ends in the knitting width at the front needle bed are the same position as the position of the boundary X on the non-joining side of the little finger tubular finger portion 25 before joining and that of the thumb finger tubular finger portion 21 before joining. Thus, the wales holding the boundary X on the outer side in the knitting width of the thumb finger tubular finger portion 21 are knitted on the wales holding the boundary X of the five-finger body 70, and the wales holding the boundary X on the outer side in the knitting width of the little finger tubular finger portion 25 are knitted on the wales holding the boundary X of the five-finger body 70, and thus the wales are formed straight (in the vertical direction of the five-finger body 70補うべきで), ょうかand satisfactory outer appearance is obtained.

When the tubular finger portions are joined at the boundary to form the two-finger body 40, the boundary on the side that is not joined with the tubular finger portion becomes the boundaries (two locations) of the two-finger body 40. When the two-finger body 40 and another tubular finger portion are joined at the boundary, the boundary on the side that is not joined of the tubular finger portion and the boundary on the side that is not joined of the two-finger body 40 become the boundaries of the three-finger body 50 after joining. When the three-finger body 50 and another tubular finger portion are joined at the boundary, the boundary on the side that is not joined of the tubular finger portion and the boundary on the side that is not joined of the three-finger body 50 become the boundaries of the four-finger body 60 after joining. This is the same for other embodiments described below.

In the first embodiment, the thumb finger tubular finger portion 21, the forefinger tubular finger portion 22, the middle finger tubular finger portion 23, the ring finger tubular finger portion 24, and the little finger tubular finger portion 25 are joined at the opposing boundaries X of the adjacent tubular finger portions to form the finger crotches, as shown in (a) of FIG. 3. The positions of the boundaries X are set so that the number of loops in the knitting width direction of the back knitted fabric becomes greater than that of the palm knitted fabric, and thus when the tubular finger portions are joined at the boundaries X, the knitted fabric of each tubular finger portion has the length in the knitting width direction of the back knitted fabric longer than that of the palm knitted fabric with respect to the finger crotch, as shown in (b) of FIG. 3, and thus a glove shape complying with the shape of the hand of a person is obtained.

Furthermore, in the present embodiment, since the loops are reduced at the joining stage by forming the gores through the double stitching and bind-off process in each finger crotch. Accordingly, the body part (five-finger body) can be formed lesser number of loops than the total number of loops of the number of loops in the knitting width direction of each of the five tubular finger portion (number of loops required for one round of the tubular part), and thus is satisfactory when the gloves are worn.

SECOND EMBODIMENT

The second embodiment will be described based on a knitting process drawing of FIG. 4. The second embodiment also concerns a glove with five tubular finger portions, where the same reference numerals are denoted for components same as in the first embodiment, and the description thereof will be omitted.

The second embodiment differs from the first embodiment in that the boundaries X of the thumb finger tubular finger portion 21 are set so that the length in the knitting width direction of the front knitted fabric (knitted fabric on palm side) is longer than that of the back knitted fabric (knitted fabric on back side), and the boundaries X of the forefinger tubular finger portion 22 are set so that the length in the knitting width direction of the front knitted fabric (knitted fabric on palm side) and that of the back knitted fabric (knitted fabric on back side) are the same. The boundaries X of the middle finger tubular finger portion 23, the ring finger tubular finger portion 24, and the little finger tubular finger portion 25 are the same as in the first embodiment. The size of the gore formed by joining the thumb finger tubular finger portion 21 and the forefinger tubular finger portion 22 is such the length of the gore of the front knitted fabric (knitted fabric on palm side) is longer than that of the back knitted fabric (knitted fabric on back side).

The knitting method for the glove of the second embodiment will be specifically described based on FIG. 4. In the present embodiment, each tubular finger portion is knitted according to the following knitting processes, and then the tubular finger portions are joined together. First, the forefinger tubular finger portion 22 is knitted up to the forming location of the second finger crotch 32 (step 1). After the knitting of step 1, the boundaries X of the forefinger tubular finger portion 22 are set so that the lengths in the knitting width direction of the front and back knitted fabrics are the same lengths (the same number of loops), and furthermore, the boundary X on the thumb finger tubular finger portion 21 side is positioned on the back needle bed and the other boundary X on the middle finger tubular finger portion 23 side is positioned on the front needle bed, as shown in step 1 of FIG. 4.

The knitted fabric of the forefinger tubular finger portion 22 is rotated counterclockwise so that the boundary X on the side to be joined to the middle finger tubular finger portion 23 is positioned between the front and back needle beds (step 2).

The steps from the knitting of the middle finger tubular finger portion 23 of step 3 to the rotating operation of the four-finger body 60 of step 17 perform the same knitting as in the first embodiment. Therefore, the knitting processes from step 3 to step 17 are the same as in the first embodiment, and the description will be omitted.

The thumb finger tubular finger portion 21 is knitted to the forming location of the first finger crotch 31 (step 18). After the knitting of step 18, two boundaries X are set at two locations in the thumb finger tubular finger portion 21 so that the boundary X on the side to be joined to the four-finger body 60 is positioned on the back needle bed, and the other boundary X on the other side is positioned between the front and back needle beds, as shown in step 18 of FIG. 4. The boundaries X are set so that the number of loops in the knitting width direction of the knitted fabric on palm side (front knitted fabric) is greater than that of the knitted fabric on back side (back knitted fabric).

The knitted fabric of the thumb finger tubular finger portion 21 is rotated clockwise so that the boundary X on the side to be joined to the four-finger body 60 is positioned between the front and back needle beds (step 19). The thumb finger tubular finger portion 21 is moved so that the loop at the end of the knitting width is adjacent to the loop at the end of the knitting width of the four-finger body 60. The movement of the little finger tubular finger portion 25 is also performed similar to the movement of the middle finger tubular finger portion 23 in the first embodiment described above and in transferring loops, but the racking of the back needle bed is performed in the opposite direction. As a result of the movement of the thumb finger tubular finger portion 21, the boundary X of the thumb finger tubular finger portion 21 and the boundary X of the four-finger body 60 oppose each other (step 20).

From state of step 20, the four-finger body 60 and the thumb finger tubular finger portion 21 are joined from the boundary X. Specifically, similar to the joining of the forefinger tubular finger portion 22 and the middle finger tubular finger portion 23, the bind-off process is performed after double stitching to join the four-finger body 60 and the thumb finger tubular finger portion 21. The bind-off process is performed up to a position b8 for the front knitted fabric and up to a position a8 for the back knitted fabric with respect to the four-finger body 60, and up to a position b7 for the front knitted fabric and up to a position a7 for the back knitted fabric with respect to the thumb finger tubular finger portion 21.

The state of step 21 is obtained at the point the joining by the bind-off process is terminated, and the first finger crotch 31 having a gore at the joined part of the four-finger body 60 and the thumb finger tubular finger portion 21 is formed. The gore of the first finger crotch 31 has the length of the gore of the back knitted fabric (back side) shorter than the length of the gore of the front knitted fabric (palm side). The five-finger body 70 having less number of loops than the total number of loops of the four-finger body 60 and the thumb finger tubular finger portion 21 can be formed by the double stitching when forming the gore.

The five-finger body 70 completed with formation of gores is then circling-knitted at the same number of loops to the vicinity of the hand inserting opening 12, and thereafter, knitted while reducing the loops up to the rib knitting portion that is to become the hand inserting opening 12. In the circling-knitting of the five-finger body 70, the positions of the boundaries X of the four-finger body 60 and the thumb finger tubular finger portion 21 before rotating the knitted fabric for joining are at the same position as the positions of the boundaries of the five-finger body 70 after the gore is formed, with respect to the end in the knitting width at the front needle bed, and accordingly, twisted loops are not formed in the five-finger body 70. Thus, circling-knitting can be continuously carried out after the formation of the gore. Furthermore, in the second embodiment, the wales holding the boundary X located at both ends in the knitting width of the five-finger body 70 are knitted on the wales holding the boundary X on the outer side in the knitting width of the thumb finger tubular finger portion 21 and the little finger tubular finger portion 25 to form the wales straight (in vertical direction of the five-finger body 70*0092 と同), and satisfactory outer appearance is obtained, similar to the first embodiment.

In the second embodiment, the thumb finger tubular finger portion 21, the forefinger tubular finger portion 22, the middle finger tubular finger portion 23, the ring finger tubular finger portion 24, and the little finger tubular finger portion 25 are connected at the opposing boundaries X of the adjacent tubular finger portions to form the finger crotches, as shown in (a) of FIG. 5. The positions of the boundaries X are set so that the number of loops in the knitting width direction of the back knitted fabric becomes less than the number of loops of the palm knitted fabric for the thumb finger tubular finger portion 21, the number of loops of the front and back knitted fabrics become the same numbers for the forefinger tubular finger portion 22, and the number of loops in the knitting width direction of the back knitted fabric becomes larger than that of the palm knitted fabric for the middle finger tubular finger portion 23, the ring finger tubular finger portion 24, and the little finger tubular finger portion 25.

Furthermore, the size of the gore of the front knitted fabric (knitted fabric on palm side) is larger than that of the back knitted fabric (knitted fabric on back side) for the first finger crotch 31, and the size of the gore of the back knitted fabric (knitted fabric on back side) is larger than that of the front knitted fabric (knitted fabric on palm side) for the second finger crotch 32 to the fourth finger crotch 34. When the tubular finger portions are joined at the boundaries X to form the finger crotches in such manner, the length in the knitting width direction of the back knitted fabric is longer than that of the palm knitted fabric with respect to the finger crotch for the forefinger tubular finger portion 22, the middle finger tubular finger portion 23, the ring finger tubular finger portion 24, and the little finger tubular finger portion 25, and the length in the knitting width direction of the back knitted fabric is shorter than that of the palm knitted fabric with respect to the finger crotch for the thumb finger tubular finger portion 21, as shown in (b) of FIG. 3. Thereby, a glove shape that complies more with the shape of a human hand is obtained.

Furthermore, since the gores are formed through double stitching and the bind-off process when forming each finger crotch in the present embodiment as well, the body part (five-finger body) can be formed with the number of loops less than the total number of loops of the number of loops in the knitting width direction (number of loops required for one round of the tubular part) of each of the five tubular finger portion, and thus is satisfactory when the gloves are worn.

Each embodiment described above has been described regarding the knitting method of the glove, but similar knitting can also be performed when knitting a sock with five tubular finger portions.

THIRD EMBODIMENT

Each embodiment described above is an embodiment related to gloves, but the knitting method of the present invention can also be applied to a sweater as shown in FIG. 6. The third embodiment shows a case of separately knitting tubular body (tubular parts) and tubular sleeves (tubular parts) using a normal two-bed flat knitting machine, and joining the body and the sleeves to knit a sweater.

FIG. 6 is a plan view of parts of a sweater 100 whose front body and sleeves are viewed from the front body side. FIG. 7 is a knitting process drawing of the sweater 100 knitted by a knitting method of the present invention, showing the knitting processes of when joining the body and the sleeve.

The sweater 100 knitted in the third embodiment is a long-sleeved sweater with a neckline, having a front body 2*a*, a back body 2*b*, a left sleeve 3, and a right sleeve 4. The front body 2*a* and the back body 2*b* have a hem part 81, side parts 82, armhole parts 83, and a neckline part 84, as shown in FIG. 6. In the illustrated embodiment, the front body 2*a* and the back body 2*b* have different body widths, where the body width of the front body 2*a* is narrower than the body width of the back body 2*b*. The left sleeve 3 and the right sleeve 4 have the dimension of the width of the front knitted fabric 3*a*, 4*a* and the dimension of the width of the back knitted fabric 3*b*, 4*b* of the same width.

In the illustrated embodiment, the front body 2*a* and the back body 2*b* are knitted in a tubular form to form the body, and the left and right sleeves 3, 4 are each knitted in a tubular form. It is to be noted that in the present embodiment, the terms to describe the right and left sides of the body and the sleeves herein, such as, for example, right and left of the left sleeve 3 and the right sleeve 4, mean the right side and the left side when viewed from a person putting on the sweater 100.

The knitting procedure of the sweater 100 of the embodiment is described below. In the embodiment, the back body 2*b*, the back knitted fabrics of the left sleeve 3 and the right sleeve 4 are knitted primarily with even needles on the back needle bed. The front body 2*a*, the front knitted fabrics of the left sleeve 3 and the right sleeve 4 are knitted primarily with odd needles on the front needle bed.

For convenience of explanation, the knit structure of the front body 2*a*, back body 2*b* and sleeves 3, 4 of the sweater 100 is presented in the form of a plain knit structure with no pattern, and the knit structure of hem parts 81 of the front body 2*a* and back body 2*b* and the knit structure of cuff parts 30, 40 of the sleeves 3, 4 are presented in the form of a rib knit structure, but the front body 2*a*, the back body 2*b*, the right sleeve 4 and the left sleeve 3 may have another knit structure, such as jacquard and rib.

First, three yarn feeders are prepared for the knitting of the body and the right and left sleeves, so that knitting yarns are fed from the respective yarn feeders to needles of the needle beds to knit three tubular bodies of the right sleeve, the body, and the left sleeve, respectively.

Specifically, the front body 2*a* and the back body 2*b* are knitted in a tubular form from the hems up to the joining starting location (A, a, C, c) with the sleeves as shown in FIG. 6. The left sleeve 3 and the right sleeve 4 are each knitted in a tubular form from the cuff parts up to the joining starting location (E, g, G, g) with the body.

The joining of the body 2 and the left sleeve 3 starts at point A of the front body 2*a*, points E, G of the left sleeve 3, and point C of the back body 2*b*. The joining of the body 2 and the right sleeve 4 starts at point a of the front body 2*a*, points e, g of the right sleeve 4, and point c of the back body 2*b*. In the embodiment, the body 2, the left sleeve 3, and the right sleeve 4 are each knitted as a separate tubular knitted fabric until the start of the joining of the body and the sleeves.

In the present embodiment, point A and point C define one boundary Z of the front body 2*a* and the back body 2*b* and point a and point c define the other boundary Z of the front body 2*a* and the back body 2*b*, when the body 2 is knitted to a continuous tubular form. Moreover, point E and point G define a joining side boundary Y of the front knitted fabric and the back knitted fabric of when the left sleeve 3 shown in FIG.

7 is knitted to a continuous tubular form, and point e and point g define a joining side boundary X of the front knitted fabric and the back knitted fabric of when the right sleeve 4 shown in FIG. 7 is knitted to a continuous tubular form.

In the embodiment, the gores are formed at A-B and a-b of the front body 2*a*, C-D and c-d of the back body 2*b*, E-F of the front knitted fabric of the left sleeve 3, G-H of the back knitted fabric of the left sleeve 3, e-f of the front knitted fabric of the right sleeve 4, and g-h of the back knitted fabric of the right sleeve 4. A-B of the front body 2*a* and E-F of the front knitted fabric of the left sleeve 3 are joined together, and a-b of the front body 2*a* and *e-f* of the front knitted fabric of the right sleeve 4 are joined together. Further, C-D of the back body 2*b* and G-H of the back knitted fabric of the left sleeve 3 are joined together, and c-d of the back body 2*b* and *g-h* of the back knitted fabric of the right sleeve 4 are joined together. In the illustrated embodiment, the gores of the front knitted fabrics are made larger in length than those of the back knitted fabrics. When the joining of the gore parts is completed, the body and the sleeves are combined as a single tubular body.

When joining of the body 2 and the left and right sleeves 3, 4 starts, the left and right sleeves 3, 4 are joined to the armhole parts 83. After the joining of the body 2 and the sleeves 3, 4 is completed, the shoulder parts of the front body 2*a* and the back body 2*b* are joined to complete the sweater 100.

In the present embodiment, the sweater is knitted so that the length in the knitting width direction (number of wale) of the front knitted fabric is shorter than that of the back knitted fabric for the tubular body while the gore parts of the front knitted fabric and the gore parts of the back knitted fabric (number of wale) are the same size for the body and the sleeves. In the knitting process diagram of FIG. 7, the knitting method from immediately before the start of the joining of the body 2 and the sleeves 3, 4, until the gore formation is completed is shown. The knitting processes will be described below based on FIG. 7. The numerals at the left side of FIG. 7 indicate the respective steps.

The step 1 shown in FIG. 7 shows the state of the body 2 and the right and left sleeves 3, 4 separately knitted in a tubular form until immediately before the start of the joining of the body 2 and the sleeves 3, 4. The right and left sleeves 3, 4 are knitted at both sides with the body 2 is knitted at the center. In FIG. 7, boundaries of the front body 2*a* and the back body 2*b* of the body are indicated by Z. Boundaries of the front knitted fabric 3*a*, and the back knitted fabric 3*b* are indicated by Y, Y for the left sleeve 3, and the boundaries of the front knitted fabric 4*a*, and the back knitted fabric 4*b* are indicated by X, X for the right sleeve 4.

In the step 1, the boundaries Z of the body 2, the boundaries Y of the left sleeve 3, and the boundaries X of the right sleeve 4 are all set to be symmetric in the knitting width of the loops held on the needle beds (respectively). Of the boundaries Z, Y, and X, the boundaries Z of the body 2 are set so that the number of loops in the knitting width direction of the back knitted fabric becomes greater than that of the front knitted fabric, and the boundaries Y of the left sleeve 3 and the boundaries X of the right sleeve 4 are set so that the number of loops in the knitting width direction of the front and back knitted fabrics are of the same number.

The knitted fabric of the body 2 is rotated counterclockwise so that the boundary Z on the side to be joined with the left sleeve 3 are positioned between the front and back needle beds. The left sleeve 3 is then moved close to the body 2, and the body 2 and the left sleeve 3 are brought adjacent to each other (step 2). The movement of the left sleeve 3 is carried out similar to the movement of the middle finger tubular finger portion 23 of the first embodiment described above. The boundary Z of the body 2 and the boundary Y of the left sleeve 3 then oppose each other between the front and back needle beds through the operation of step 2.

From the state of step 2, the body 2 and the left sleeve 3 are joined from the boundaries Z, Y. Specifically, the body 2 and the left sleeve 3 are joined by double stitching the front knitted fabrics and the back knitted fabrics from the boundaries Z, Y and then performing the bind-off process. The gores are formed from point A to point B for the front knitted fabric and from point C to point D for the back knitted fabric with respect to the body 2, and from point E to point F for the front knitted fabric and from point G to point H for the back knitted fabric with respect to the left sleeve 3 (step 3). The state of step 4 is obtained at the point the joining by the bind-off process is terminated.

After the body 2 and the left sleeve 3 are joined and the formation of the gores is completed, the right sleeve 4 is moved close to the body 2. The knitted fabric of the body 2 is rotated clockwise so that the boundary Z on the side to be joined to the right sleeve 4 is positioned between the front and back needle beds (step 5). The boundary Z of the body 2 and the boundary X of the right sleeve 4 then oppose each other between the front and back needle beds through the operation of step 5.

From the state of step 5, the body 2 and the right sleeve 4 are joined from the boundaries Z, X. Specifically, the body 2 and the right sleeve 4 are joined by double stitching the front knitted fabrics and the back knitted fabrics from the boundaries Z, X and then performing the bind-off process. The gores are formed from point a to point b for the front knitted fabric and from point c to point d for the back knitted fabric with respect to the body 2, and from point e to point f for the front knitted fabric and from point g to point h for the back knitted fabric with respect to the right sleeve 4 (step 6). The state of step 7 is obtained at the point the joining by the bind-off process is terminated. The left sleeve 3 and the right sleeve 4 are combined to the body 2 as a single tubular body through step 7.

The tubular part is rotated counterclockwise in the state of step 8 so that the boundary Y on the left sleeve side and the boundary X on the right sleeve side, which are not joined, are symmetric in the knitting width of the respective knitted fabrics held on the front needle bed. The knitting is then continued in a tubular form so that the body 2 and the left and right sleeves are joined up to the shoulder part from the relevant state.

In the third embodiment, the positions of the boundaries on the non-joining side of the left and right sleeve 3, 4 are at the different positions immediately before the start of the joining and immediately after the formation of the gore with respect to the end in the knitting width of the knitted fabric held on the needle bed. If the positions of the boundaries differ in such a way, after knitting the sleeves up to the joining starting location with the normal operation and rotating the sleeves through transferring loops from one needle bed to the other needle bed to form the gores, the loops on the outer side of the boundaries in the knitting width direction tend to be twisted.

Thus, the loops are preferably twisted in advance at the knitting stage immediately before the start of the joining for the number of loops the positions of the boundaries are shifted from the positions of the boundaries in the state of step 1 and the positions of the boundaries in the state of step 8.

Specifically, circling-knitting is performed in the same direction as the direction of rotation of the sleeves when separately knitting the left sleeve 3 and the right sleeve 4. In the final course of knitting immediately before joining, the loops that are not returned to the one needle bed after gore formation is are twisted in advance in the direction of canceling the twist after transferring the loops transferred from the one needle bed to the other needle bed. Therefore, the loops are prevented from being twisted when transfer is performed by twisting the loops in advance, thereby achieving an outstanding outer appearance.

INDUSTRIAL APPLICABILITY

The knitting method of the present invention is suited for knitting gloves and socks with tubular finger portions knitted in a seamless manner using the flat knitting machine.

DESCRIPTION OF SYMBOLS

Figure 1:
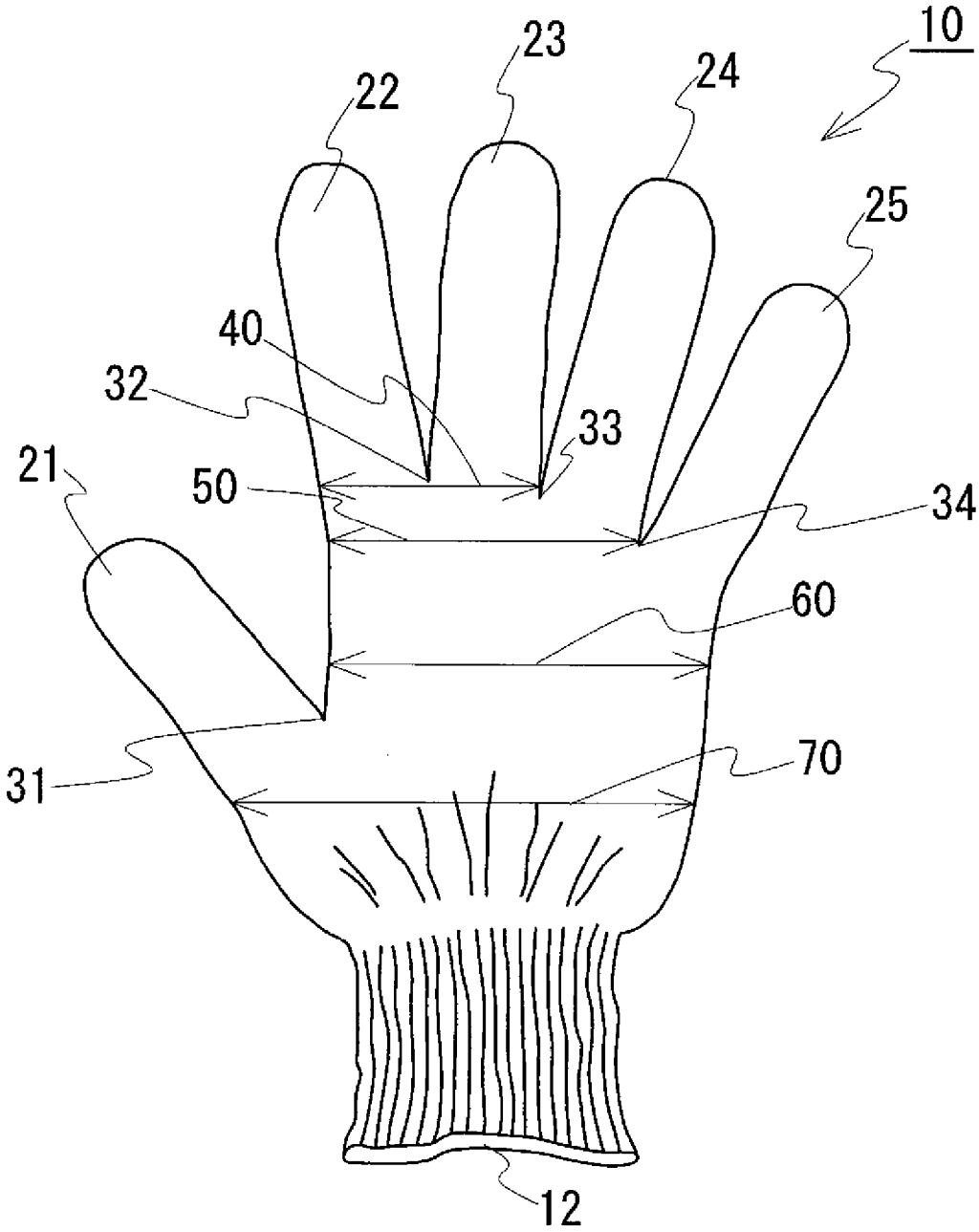
FIG. 1 shows a plan view of a glove serving as a first embodiment of a knitting method of a glove according to the present invention.
Figure 2:
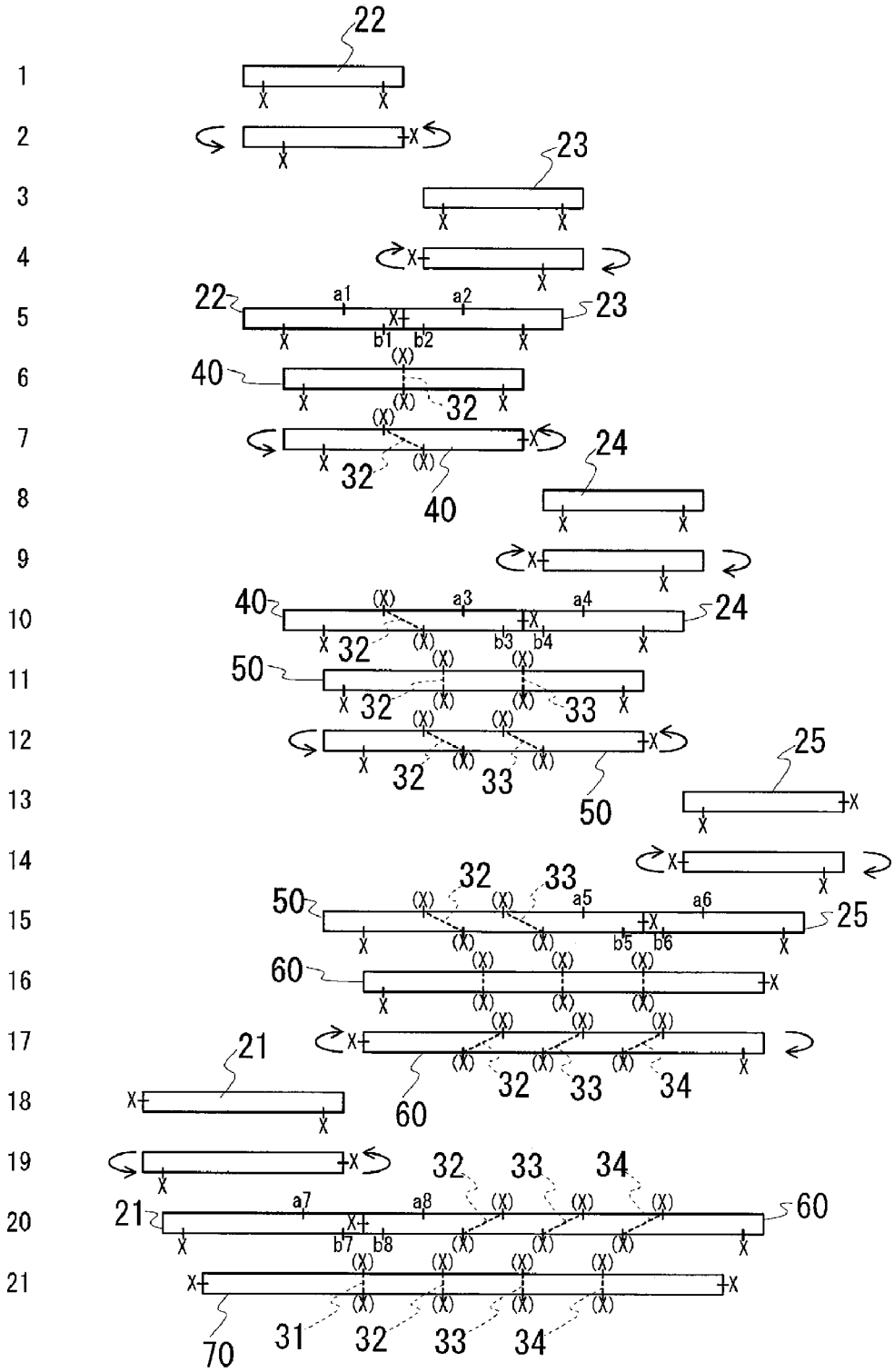
FIG. 2 is a knitting process diagram of the glove according to the first embodiment.
Figure 3:
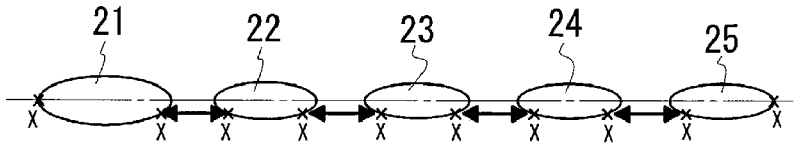
FIG. 3 is an explanatory view showing the cross sectional state of the tubular finger portion of the glove of the first embodiment.
Figure 3:
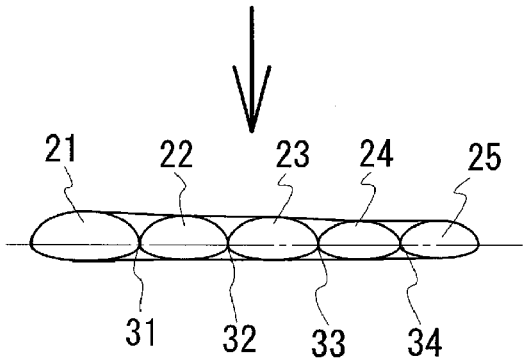
Figure 4:
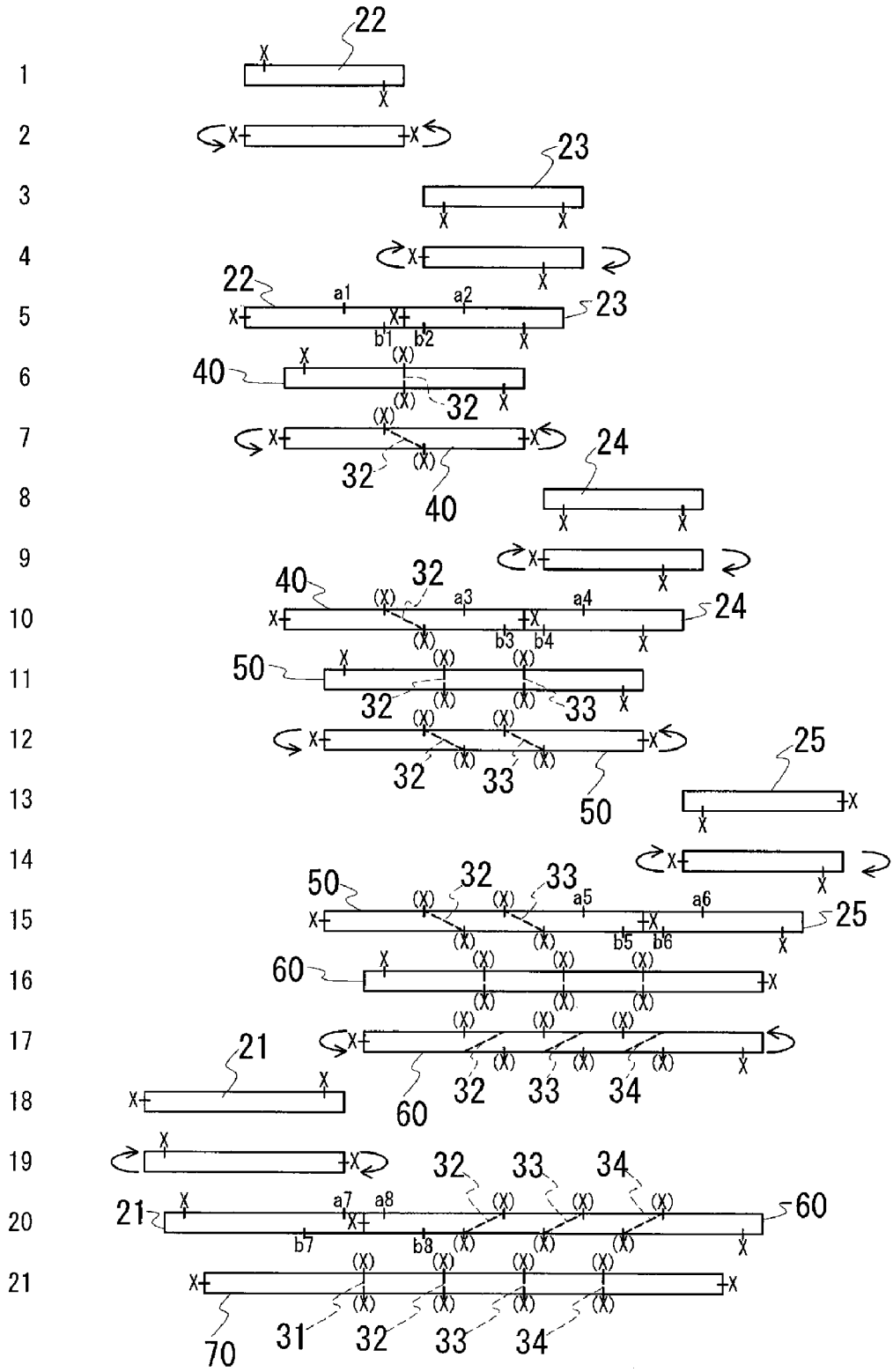
FIG. 4 is a knitting process diagram of the glove according to a second embodiment.
Figure 5:
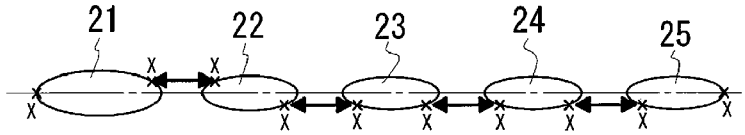
FIG. 5 is an explanatory view showing the cross sectional state of the tubular finger portion of the glove of the second embodiment.
Figure 5:
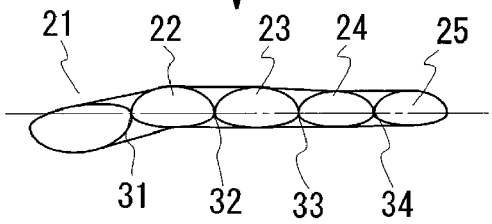
Figure 6:
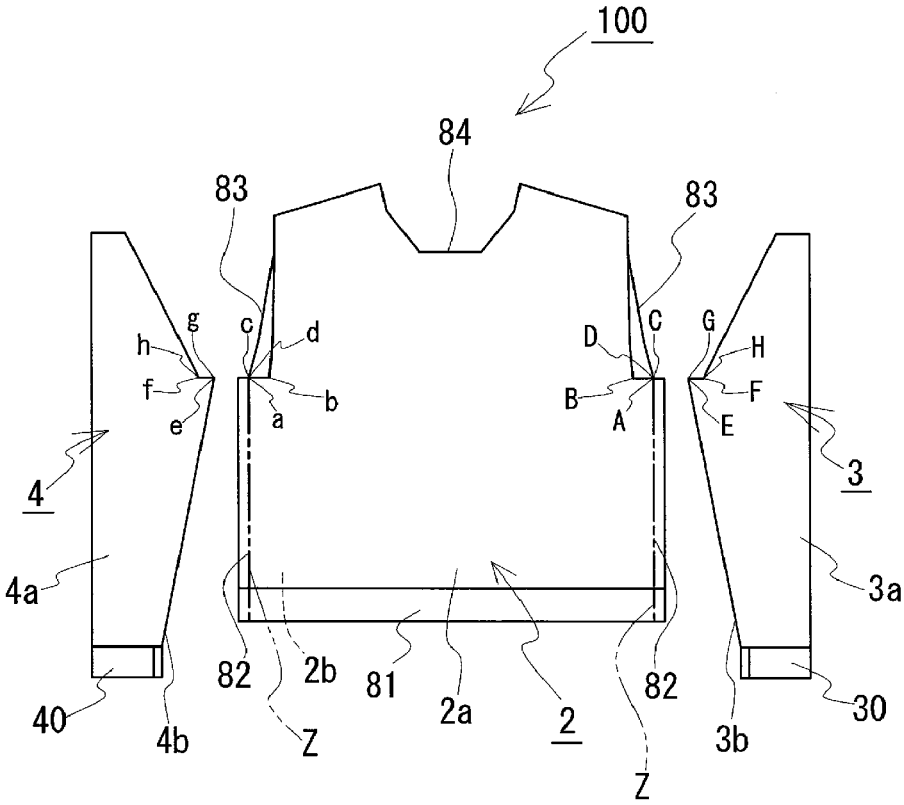
FIG. 6 shows an embodiment (third embodiment) of a knitting method of a sweater according to the present invention, showing parts of the sweater.
Figure 7:
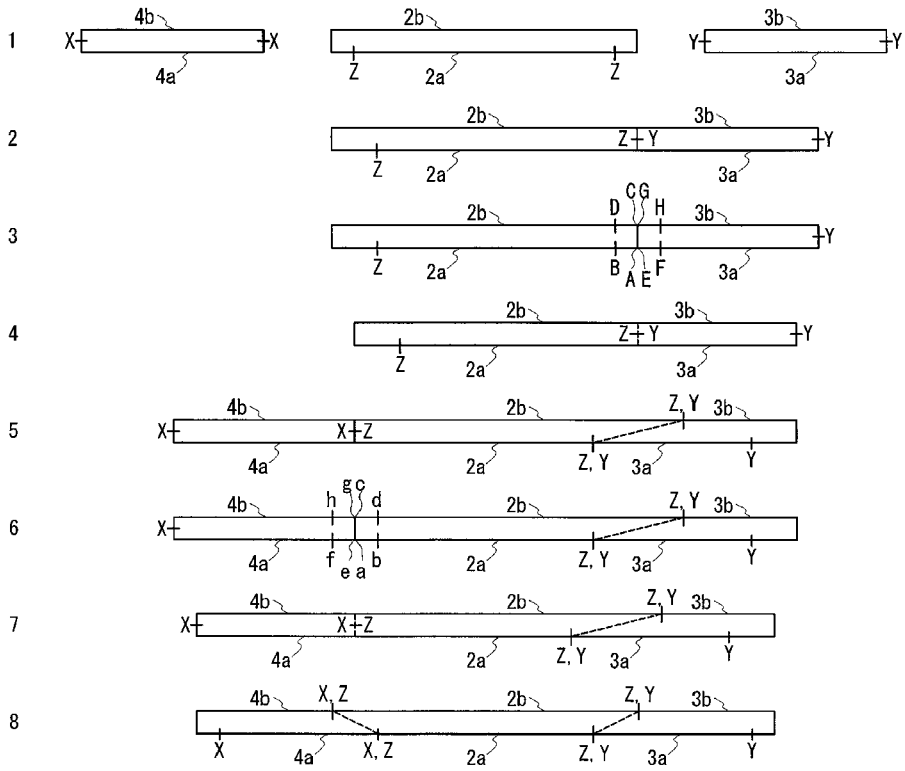
FIG. 7 is a knitting process diagram of a sweater according to the third embodiment.
Figure 8:
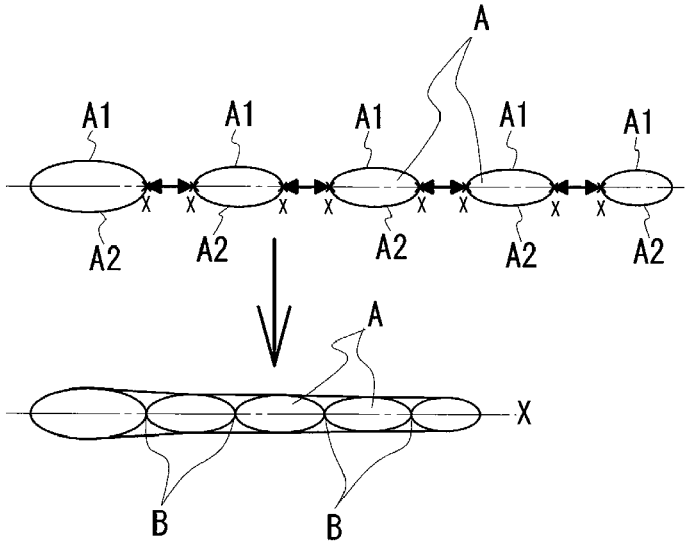
FIG. 8 is an explanatory view showing a state of a cross section of a tubular finger portion of a conventional glove.

10 glove
12 hand inserting opening
21 thumb finger tubular finger portion
22 forefinger tubular finger portion
23 middle finger tubular finger portion
24 ring finger tubular finger portion
25 little finger tubular finger portion
31 first finger crotch
32 second finger crotch
33 third finger crotch
34 fourth finger crotch
40 two-finger body
50 three-finger body
60 four-finger body
70 five-finger body
100 sweater
2 body
2*a* front body
2*b* back body
81 hem part
82 side part
83 armhole part
84 neckline part
3 left sleeve
3*a* front knitted fabric
3*b* back knitted fabric
30 cuff part
4 left sleeve
5*a* front knitted fabric
5*b* back knitted fabric
50 cuff part

The invention claimed is:

1. A knitting method of a tubular knitted fabric formed by joining at least three separately knitted tubular parts using a flat knitting machine having at least a pair of front and back needle beds extending in a transverse direction and disposed opposite to each other in a cross direction, at least either of which is racked in the transverse direction so that loops can be transferred between the front and back needle beds, the method comprising the step of:

an operation of joining two tubular parts at a boundary of front and back knitted fabrics to form a tubular part is repeated; wherein the boundary is set so that the front knitted fabric and the back knitted fabrics are different in length in a knitting width direction immediately before joining for at least one tubular part; and, the tubular part in which the front and back knitted fabrics are different in length in the knitting width direction and the boundary to be joined is not positioned between the front and back needle beds is rotated so that the boundary is positioned between the front and back needle beds; and two adjacent tubular parts having the boundaries opposed to each other between the needle beds are joined while holding the boundary in between after the rotation.

2. The knitting method of the tubular knitted fabric according to claim 1, comprising the steps of:

a) rotating the tubular part in which the boundary on the joining side is not positioned between the front and back needle beds so as to position the boundary on the joining side between the front and back needle beds for the two tubular parts to be joined;

b) joining the front knitted fabrics and the back knitted fabrics of the two tubular parts respectively by double stitching and binding off the loops with the boundaries in between;

c) rotating the tubular part in which the boundary on the joining side is not positioned between the front and back needle beds so as to position the boundary on the joining side between the front and back needle beds for the tubular part formed in one tubular form by joining the two tubular parts and the tubular part to be joined next;

d) joining the front knitted fabrics and the back knitted fabrics of the two tubular parts in the state of step c respectively by double stitching and binding-off the loops with the boundaries in between;

e) repeating step c to step d until all the tubular parts are joined when the tubular parts to be joined are four or more.

3. The knitting method of the tubular fabric according to claim 1, wherein a gore is formed at a joined part of the two tubular parts.

4. The knitting method of the tubular fabric according to claim 2, wherein a gore is formed at a joined part of the two tubular parts.

5. The knitting method of the tubular fabric according to claim 4, wherein the gore of the front and back knitted fabrics, which is formed when joining the tubular parts, are different in.

6. The knitting method of the tubular fabric according to claim 5, wherein the position of the boundary on the non-joining side of the tubular part is set to be in the same position on the needle bed with respect to the end in the knitting width immediately before joining and after joining.

7. The knitting method of the tubular fabric according to claim 1, wherein the tubular knitted fabric is a glove or a sock with tubular finger portions knitted from finger tip; and the tubular part includes a tubular part forming a tubular finger portion, a tubular part formed by joining two tubular finger portions, and a tubular part formed by sequentially joining at least three tubular finger portions.

8. The knitting method of the tubular fabric according to claim 1, wherein the tubular knitted fabric is a sweater having a body and sleeves; and a tubular part forming the body and a tubular part forming one sleeve are joined, and thereafter, a tubular part in which the two tubular parts are joined and a tubular part forming another sleeve are joined.

9. A knitting program encoded on a computer-readable medium for joining at least three separately knitted tubular parts using a computerized flat knitting machine having at least a pair of front and back needle beds extending in a transverse direction and disposed opposite to each other in a cross direction, at least either of which is capable of being racked in the transverse direction so that loops can be transferred between the front and back needle beds, the knitting program comprising:

a determining command of determining two tubular parts to be joined;

a setting command of setting positions of boundaries of a front knitted fabric and a back knitted fabric immediately before joining so that length in a knitting width direction of the front knitted fabric and the back knitted fabric are of desired length when the tubular parts are joined for the tubular parts determined to be joined by the determining command;

a rotation command of rotating the tubular part so that the boundary is positioned between the front and back needle beds immediately before joining for the tubular part in which length sin the knitting width direction of the front and back knitted fabrics differ and the boundary on the joining side is not positioned between the front and back needle beds by the setting command;

a joining command of joining two adjacent tubular parts in which the boundaries are opposed to each other between the needle beds while holding the boundary in between to form one tubular part according to the setting command and the rotation command for the tubular parts determined to be joined by the determining command; and a repeating command of repeating the determining command, the setting command, the rotation command, and the joining command until all the tubular parts are joined.

10. A glove or a sock with tubular finger portions knitted in a seamless manner from the tubular finger portion using a flat knitting machine in which needle beds provided with a great number of knitting needles are disposed opposite to each other in a cross direction, wherein a boundary between a front knitted fabric and a back knitted fabric immediately before joining is set so that the front knitted fabric and the back knitted fabric are different in length in a knitting width direction for at least one tubular part forming the tubular finger portion, a finger crotch being formed by joining adjacent tubular parts at the opposing boundaries.

11. A sweater including a body and sleeves knitted in a seamless manner from a hem part using a flat knitting machine in which needle beds provided with a great number of knitting needles are disposed opposite to each other in a cross direction, wherein a boundary between a front knitted fabric and a back knitted fabric of the body and the sleeves immediately before joining is set so that lengths of the front knitted fabric and the back knitted fabric in a knitting width direction of a tubular part forming the body are different, and the lengths of the front knitted fabric and the back knitted fabric in a knitting width direction of tubular parts forming the sleeves are the same, the tubular part forming the body and the tubular parts forming the sleeves being joined at the opposing boundaries.

* * * * *